United States Patent [19]

Yoneyama et al.

[11] 3,938,999

[45] Feb. 17, 1976

[54] ANTISTATIC PHOTOGRAPHIC SENSITIVE MATERIALS

[75] Inventors: Masakazu Yoneyama; Nobuo Yamamoto; Naohiko Sugimoto; Ikutaro Horie, all of Minami-ashigara; Yasuhiro Nakayama, Fujimiya, all of Japan

[73] Assignee: Fuji Photo Film Co., Ltd., Minami-ashigara, Japan

[22] Filed: Mar. 31, 1975

[21] Appl. No.: 563,904

[30] Foreign Application Priority Data

Mar. 30, 1974 Japan ..... 49-36410

[52] U.S. Cl. ..... 96/84 R; 96/67; 96/85; 96/87 A; 96/114; 96/114.2; 96/114.5

[51] Int. Cl.[2] ..... G03C 1/84; G03C 1/82

[58] Field of Search ..... 96/87 A, 84 R, 114.2, 67, 96/50 PL, 114, 114.5

[56] References Cited

UNITED STATES PATENTS

| | | | |
|---|---|---|---|
| 3,597,208 | 8/1971 | Nishio et al. | 96/67 |
| 3,676,209 | 7/1972 | Mackey et al. | 96/114.2 |
| 3,753,716 | 8/1973 | Ishihara et al. | 96/87 A |
| 3,769,020 | 10/1973 | Verberg | 96/87 A |
| 3,791,831 | 2/1974 | von Bonin et al. | 96/87 A |
| 3,811,899 | 5/1974 | Endou et al. | 96/87 A |
| 3,856,530 | 12/1974 | Van Paesschen | 96/87 A |
| 3,877,942 | 4/1975 | Nagatomo et al. | 96/67 |

*Primary Examiner*—Ronald H. Smith

*Attorney, Agent, or Firm*—Sughrue, Rothwell, Mion, Zinn & Macpeak

[57] ABSTRACT

An antistatic photographic sensitive material comprising a support having thereon at least one silver halide emulsion layer, wherein a surface active copolymer containing in the main chain a repeating unit represented by the formula (I)

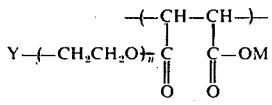

(I)

wherein Y represents an organic residue having 4 to 22 carbon atoms; n represents the average number of ethyleneoxy units and is 1 to 100; and M represents a hydrogen atom, an alkali metal atom, an alkaline earth metal atom, an ammonium group or an alkylammonium group is present in at least one of a surface of the support and a photographic layer.

12 Claims, No Drawings

ANTISTATIC PHOTOGRAPHIC SENSITIVE MATERIALS

BACKGROUND OF THE INVENTION

1. Field of the Invention

The present invention relates to antistatic photosensitive materials and particularly to antistatic photosensitive materials wherein a copolymer containing therein a repeating unit of a maleic acid ester having an ethyleneoxy chain in the main chain is present in a layer of the photosensitive material.

2. Description of the Prior Art

Photosensitive materials are generally composed of a support of a film of a poly-α-olefin such as polyethylene, or polystyrene, a film of a cellulose ester such as cellulose triacetate, a film of a polyester such as polyethylene terephthalate, a paper, a synthetic paper or a coated paper, and photosensitive emulsion layers and, if desired, intermediate layers, a protective layer, a back layer, an antihalation layer and an antistatic layer, which are provided on one or both surfaces of the support through a subbing layer. Examples of photosensitive materials wherein photographic emulsion layers are applied to both surfaces of the support, are, for example, direct printing X-ray films. However, in most photographic sensitive materials, the photographic emulsion layers are provided on only one surface of the support. Thus, in the latter case, a photographic emulsion is not applied to one surface of the support. Hereinafter such a surface will be designated the back face of the photographic sensitive material. Since photographic sensitive materials comprise a support which is electrically insulating and photographic layers, electrostatic charges often accumulate when the photographic sensitive material rubs in contact with a surface of the same or of different materials or is separated during their production or during their use. The accumulated electrostatic charges cause many difficulties. For example, in a photographic film before developing, the photosensitive emulsion layer is exposed due to a discharge of the accumulated electrostatic charges and, consequently, dot-like spots or branched or feather-like line marks appear on development of the photographic film. These spots are the so-called static marks, which result in a marked deterioration in the commercial value of the photographic film. For example, it can be easily understood that a serious danger can occur when they appear on medical or industrial X-ray films. Since this phenomenon becomes clear for the first time only after development, it is one of the most troublesome problems. Further, the accumulated electrostatic charges cause dust to adhere to the film surfaces and induce secondary difficulties such as uneven coated layers.

These electrostatic charges often accumulate in the production of the photographic sensitive material and on use thereof as described above. For example, they are generated by friction between the photographic film and rolls in production or by separation of the support surface and the emulsion layer surface on winding or rewinding the photographic film. Further, in finished goods, they are generated by separation of the support surface and the emulsion layer surface on rewinding at high humidity so that adhesion of the photographic film occurs, by friction between the film and the metal parts of a camera or a separation of the support surface and the emulsion layer surface during photographing and rewinding of a movie film, or by contact and separation between the film and the mechanical parts of an X-ray automatic photographing machine or a fluorescent sensitizing paper. In addition, they are generated by contact with packing materials. Generation of static marks on photosensitive materials induced by accumulation of electrostatic charges are further increased when the sensitivity of the photographic sensitive materials is increased or when processing rate of the photographic sensitive materials is increased.

Although it is believed that charging by friction or by separation results from an ionic interaction between the molecules present in the contacting materials, it is now difficult to chemically estimate what kind of material can be used to form positive charges and what kind of material can be used to form negative charges. However, it is easily considered that thus electrostatic charging can be prevented by reducing the applied electric voltage or by increasing the electric conductivity of the surface of the materials so that electrostatic charges are dispersed within a very short time before partial discharging occurs due to an accumulation of charges. Accordingly, methods of improving the conductivity of the surface of the support or a coating layer of the photosensitive materials have hitherto been found, and thus use of many kinds of hygroscopic materials, water soluble inorganic salts, surface active agents and polymer has been attempted. For example, the polymers as described in U.S. Pat. Nos. 2,882,157, 2,972,535, 3,062,785, 3,262,807, 3,514,291 and 3,615,531, the surface active agents as described in U.S. Pat. Nos. 2,982,651, 3,428,456, 3,457,076, 3,454,625, 3,552,972 and 3,655,387 and zinc oxide, semiconductors and colloidal silica as described in U.S. Pat. Nos. 3,062,700, 3,245,833 and 3,525,621 are known.

As a method of directly providing the photographic film support with antistatic properties, a process is known which comprises adding such material directly into a high molecular weight material for the support or applying such material to a surface of the support. In the latter case, the antistatic agent can be applied individually or in a combination with a high molecular weight material such as gelatin, polyvinyl alcohol or cellulose acetate to form a backing layer. Further, as a method of providing photographic sensitive material with antistatic properties, a process which comprises incorporating an antistatic agent in a photographic emulsion layer or a surface protective layer thereof or applying a solution of the antistatic agent to the surfaces of these layers is known. However, the above described materials exhibit specific properties depending on the kind of film support or photographic composition. For example, although a certain material may provide a good result with a specific film support and a specific photographic emulsion or another photographic element, it is sometimes not only useless as an antistatic agent for other film supports and other photographic elements but may also adversely influence the photographic properties.

In general, there are few materials which exhibit sufficient effects at low humidity (about 30 percent RH or lower) for high speed emulsions, and sometimes a deterioration of the antistatic effect with the lapse time occurs with such materials and adhesion difficulties at high temperature and high humidity result. Particularly, it is difficult to establish a technique for effectively utilizing the antistatic agents in photosensitive materials wherein a photographic emulsion is applied to both surfaces of the support such as a direct printing X-ray film. Further, although it is desired to obtain photosensitive materials which have a low surface resistivity at a low humidity (about 30 percent RH or less), many difficulties occur in the production of such photosensitive materials. Particularly, a technique of providing such a characteristic to the photographic emulsion layer side has not be found in the prior literature or patents. Furthermore, in finding an antistatic agent for photographic sensitive materials, attention must be paid to not only photographic properties such as sensitivity, fog, granularity or sharpness but also properties such as an appropriate coefficient of friction so that camera behavior is not deteriorated or such as tackiness must be considered. When a certain kind of synthetic surface active agent used for a coating assistant is used as an antistatic agent, the antistatic effect thereof sometimes is markedly reduced. Therefore, a large number of different antistatic agents have been tried since predictions of whether an antistatic agent will be effective in a photographic sensitive material is very difficult.

SUMMARY OF THE INVENTION

A first object of the present invention is to provide antistatic photographic sensitive materials.

A second object of the present invention is to provide high speed photographic sensitive materials having an antistatic property which have a low surface resistivity at low humidity (about 30 percent).

A third object of the present invention is to provide an effective method for providing photographic sensitive materials with an antistatic property without deteriorating photographic properties such as granularity or sharpness, etc. or surface properties such as anti-adhesion properties.

It has been found that these objects are attained with a photographic sensitive material in at least one of the photographic layers containing therein and/or at least one surface of the support having thereon a copolymer containing a repeating unit of a maleic acid ester having an ethyleneoxy chain represented by the following formula (I) in the main chain

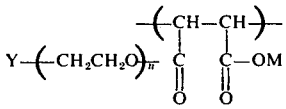

(I)

wherein, Y represents an organic residue having 4 to 22 carbon atoms; *n* represents the average number of ethyleneoxy units and ranges from about 1 to 100; and M represents a hydrogen atom, an alkali metal atom, an alkaline earth metal atom, an ammonium group or an alkylammonium group.

DETAILED DESCRIPTION OF THE INVENTION

The antistatic photographic sensitive materials of the present invention are characterized in that a copolymer containing a repeating unit of maleic acid ester having a polyethyleneoxy group in the main chain is present in a layer of the photographic sensitive material.

Y in the above formula includes any organic residue including linear, branched, cyclic, saturated or unsaturated, substituted or unsubstituted hydrocarbon groups, so long as it has 4 to 22 carbon atoms. More specifically Y represents a residue of any organic compound containing an active hydrogen atom to which ethylene oxide can bond by addition. Suitable groups for Y can be represented by the following formulae wherein R and R′, which can be the same or different, each represents an alkyl group which may be completely or partially substituted with fluorine atoms; an alkenyl group; an aralkyl group; or an aryl group; and R′ further represents a hydrogen atom.

Group R—O— 1

Examples of the group R-O- are butoxy, hexyloxy, octyloxy, decyloxy, dodecyloxy, octadecyloxy, oleyloxy, perfluorooctyloxy, 1,1,7-trihydrododecafluoroheptyloxy, phenoxy, p-aminophenoxy, p-nonylphenoxy, 2,4-diamylphenoxy, benzyloxy, 2-naphthyloxy, 4-octyl-2-naphthyloxy and like groups.

Group 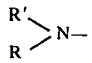 2

Examples of the group 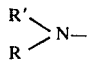

are butylamino, octylamino, dodecylamino, oleylamino, naphthylamino, perfluorooctylamino and like groups.

Group 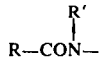 3

Examples of the group 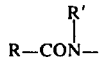

are hexanoylamino, octadecanoylamino and like groups.

Group RCOO— 4

Examples of the group RCOO- are hexanoyloxy, octadecanoyloxy, benzoyloxy and like groups.

Group R—S— 5

Examples of the group R-S- are butylthio, octylthio, dodecylthio, phenylthio, naphthylthio and like groups.

Group 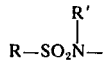 6

Examples of the group 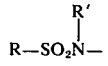

are N-propyl-N-perfluorooctanesulfonylamide, N-perfluorodecanesulfonylamide and like groups.

Examples of cations represented by M include a hydrogen atom, a sodium atom, a potassium atom, a lithium atom, a calcium atom, a barium atom, an ammonium group, and an alkyl ammonium group having 1 to 4 carbon atoms in the alkyl moieties (for example, a triethyl ammonium group and a tributyl ammonium group), etc.

Examples of comonomers (polymerizable monomers) of copolymers containing therein a repeating unit of a maleic acid ester having a polyethyleneoxy group represented by the above formula include alkyl esters of acrylic acid and methacrylic acid (for example, methyl methacrylate, ethyl acrylate, hydroxyethyl acrylate, propyl acrylate, cyclohexyl acrylate, 2-ethylhexyl acrylate, decyl acrylate, β-cyanoethyl acrylate, β-chloroethyl acrylate, 2-ethoxyethyl acrylate, and sulfopropyl methacrylate, etc.), vinyl esters (for example, vinyl acetate, vinyl propionate and vinyl butyrate, etc.), vinyl ethers (for example, methyl vinyl ether, butyl vinyl ether and oleyl vinyl ether, etc.), vinyl ketones (for example, methyl vinyl ketone and ethyl vinyl ketone, etc.), styrenes (for example, styrene, methylstyrene, dimethylstyrene, 2,4,6-trimethylstyrene, ethylstyrene, laurylstyrene, chlorostyrene, methoxystyrene, cyanostyrene, chloromethylstyrene, vinyl benzoic acid, styrenesulfonic acid and α-methylstyrene, etc.), vinyl heterocyclic compounds (for example, vinylpyridine, vinylpyrrolidone and vinylimidazole, etc.), acrylonitrile, vinyl and vinylidene halides (for example, vinyl chloride and vinylidene chloride), olefins (for example, ethylene, propylene, butadiene diisobutylene, isoprene and chloroprene), etc. The present invention is not limited to the above specifically described copolymerization monomers, and any copolymer can be used if it has the structural unit of the above described formula. Examples of typical copolymers which can be used in the present invention are shown in the following.

Compound 1

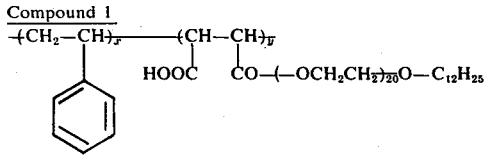

(molar ratio of x:y = 1:1)

Compound 2

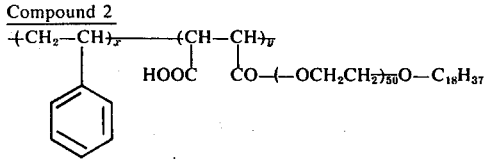

(molar ratio of x:y = 1:1)

Compound 3

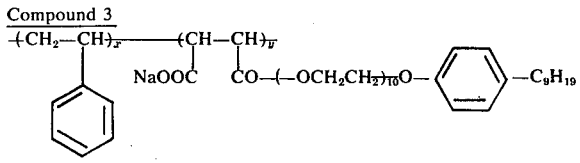

(molar ratio of x:y = 1:1)

Compound 4

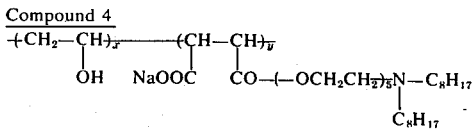

(molar ratio of x:y = 1:1)

Compound 5

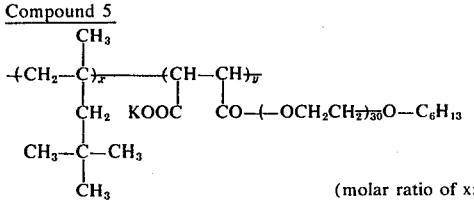

(molar ratio of x:y = 1:1)

Compound 6

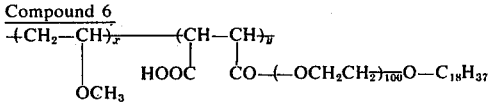

molar ratio of x:y = 1:1)

Compound 7

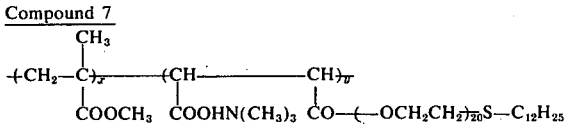

(molar ratio of x:y = 2:1)

Compound 8

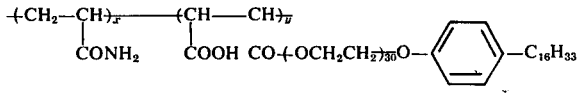

(molar ratio of x:y = 2:1)

Compound 9

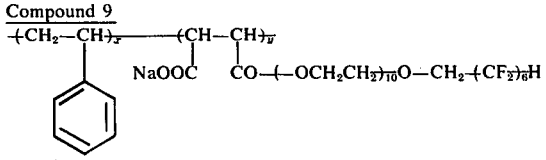

(molar ratio of x:y = 1:1)

Compound 10

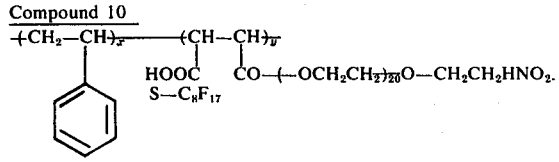

(molar ratio of x:y = 1:1)

Compound 11

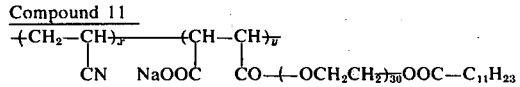

(molar ratio of x:y = 3:1)

Compound 12

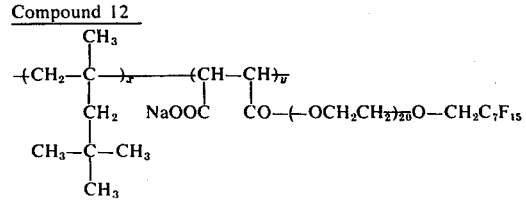

(molar ratio of x:y = 1:1)

Compound 13

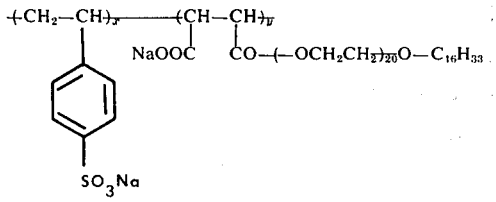

(molar ratio of x:y = 1:1)

Compound 14

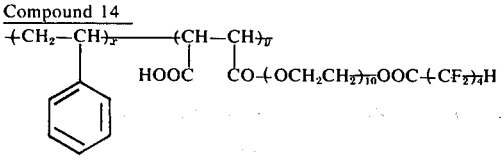

(molar ratio of x:y = 1:1)

Compound 15

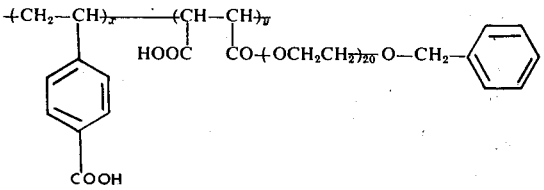

(molar ratio of x:y = 1:1)

Compound 16

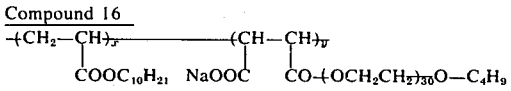

(molar ratio of x:y = 1:1)

These compounds used in the present invention can be derived from commercially available copolymers. For example, an ethylene-maleic acid anhydride copolymer a styrene-maleic acid anhydride copolymer or a methyl vinyl ether-maleic acid anhydride copolymer is mixed with an ethylene oxide adduct of an aliphatic alcohol or an ethylene oxide adduct of an alkylphenol. The mixture is stirred at a temperature in the range of from about 100° to about 150°C (not critical) for a period of from about 5 to about 9 hours, by which the maleic acid unit reacts to form a half ester by ring cleavage. Alkali salt derivatives can be formed by dissolving the product thus obtained in an aqueous alkali by heating. On the other hand, the copolymers can be easily produced by conventional methods. Although the molecular weight of the copolymers is not limited and can vary, copolymers having a molecular weight of about 500 to 50,000 and preferably 1,000 to 20,000 are preferred. Though the number of ethyleneoxy units is not limited and can vary, a range of 1 to 100 and particulary 2 to 50 is preferred.

These compounds dissolve or disperse in a solvent such as water or methanol and do not have any adverse influence upon the photographic properties such as sensitivity, gamma or fog, etc., if they are used in the above described range even though they are added to photographic emulsions.

The compound used in the present invention can be used alone or together with another antistatic agent or various additives. A preferred amount of the compound of the present invention ranges from about 0.05 to 20 g and preferably 0.01 to 0.5 g per square meter of the photographic film. Of course, the above described range changes despending on type of photographic film support used, the photographic composition used, the state or a manner of application.

In the present invention, the photographic layers comprise a silver halide emulsion layer and an auxiliary layer (for example, an intermediate layer, a protective layer, a filter layer, a backing layer, an antihalation layer, an antistatic layer, an anticurling layer and a subbing layer, etc.). It is sufficient if the copolymer represented by the above formula is incorporated in or applied to at least one of the surfaces of the support and/or is incorporated in at least one photographic layer or applied to a surface of at least one photographic layer. Where two or more silver halide emulsion layers are present on a single one surface or on both surfaces of the support, the copolymer is incorporated in or applied to at least one layer thereof. A preferred embodiment of the present invention is a photographic sensitive material which comprises a support, at least one silver halide emulsion layer applied on the support and at least one auxiliary layer, wherein the above described copolymer is present on at least one surface of the support and/or in at least one of the silver halide emulsion layer and the auxiliary layer. A photographic sensitive material comprising silver halide emulsion layers on both surfaces of a support and protective layers on the silver halide emulsion layers wherein the copolymer of the present invention is present in the protective layers is particularly preferred.

In order to employ the compound used in the present invention, the compound is dissolved in an organic solvent such as methanol, acetone or a mixture thereof. The solution is then added to coating solutions for forming photographic layers such as a photographic silver halide emulsion layer, an intermediate layer or a protective layer, and the resulting coating solutions are coated using a dip-coating method, an air-knife coating method, an extrusion coating method using a hopper as described in U.S. Pat. No. 2,681,294 or a method as described in U.S. Pat. Nos. 3,508,947, 2,941,898 and 3,526,528 to form two or more layers at the same time, or the photographic layer is dipped in the antistatic treating solution. Further, the antistatic treating solution can be applied to a surface of the support of the photographic film or the support can be dipped in the antistatic treating solution. If desired, the antistatic treating solution containing the compound of the present invention can be further applied to a protective layer.

Examples of suitable supports for the photographic sensitive materials of the present invention include, for example, a cellulose nitrate film, a cellulose acetate film, a cellulose acetate butyrate film, a cellulose acetate propionate film, a polystyrene film, a polyethyleneterephthalate film and a polycarbonate film, laminated products of these films, a thin glass film and paper. Furthermore, a good result is obtained also by using a baryta paper, a paper which is coated with or laminated with $\alpha$-olefin polymers and particularly polymers of $\alpha$-olefins having 2 to 10 carbon atoms such as polyethylene, polypropylene or an ethylene-butene copolymer, etc., or synthetic resin film supports which have a surface matted so as to improve the printability and adhesion to other high molecular weight materials as described in Japanese Patent Publication 19068/1972.

The support can be selected from transparent supports and opaque supports depending on the use of the photosensitive material. Where the support is transparent, not only colorless transparent supports but also colored transparent supports which are prepared by adding dyes or pigments can be used. This has been used hitherto for X-ray films and is described in J. SMPTE, vol. 67, 296 (1958).

Examples of opaque supports include not only essentially opaque supports such as paper but also supports prepared by adding dyes or pigments such as titanium oxide to transparent films, plastic films whose surface has been treated by the method described in Japanese Patent Publication 19068/1972, and lightintercepting papers or synthetic resin films which contain carbon black or dyes. When the adhesion between the support and the photographic emulsion layer is not sufficient, a subbing layer which has good adhesive properties to both of the photographic emulsion layer and the support is usually employed. Further, in order to further enhance the adhesive properties, the surface of the support can be subjected to a preliminary processing such as a corona discharge treatment, an ultraviolet light application or a flame treatment, etc.

In the photographic sensitive materials of the present invention, each photographic layer can contain the following binders or vehicles. Examples of hydrophilic colloids include gelatin, colloidal albumin, casein, cellulose derivatives such as carboxymethyl cellulose and hydroxyethyl cellulose, etc., saccharide derivatives such as agar agar, sodium alginate and starch derivatives, etc., and synthetic hydrophilic collids such as polyvinyl alcohol, poly-N-vinylpyrrolidone, acrylic acid copolymers, polyacrylamide and the partially hydrolyzed derivatives thereof, etc. If desired, a compatible mixture of two or more of these colloids can be used.

Of these above described colloids, gelatin is most generally used. However, a portion or all of the gelatin can be replaced by not only synthetic high molecular materials but also gelatin derivatives, namely, gelatin derivatives in which the gelatin has been modified by a compound having a reactive group which reacts with the amino groups, imino groups, hydroxy groups or carboxyl groups as a functional group in the gelatin molecule or gelatin graft polymers comprising gelatin having chains of other high molecular weight materials grafted thereto.

Examples of compounds for producing the above described gelatin derivatives include the isocyanates, acid chlorides and acid anhydrides described in U.S. Pat. No. 2,614,928, the acid anhydrides described in U.S. Pat. No. 3,118,766, the bromoacetic acids described in Japanese Patent Publication 5514/1964, the phenyl glycidyl ethers described in Japanese Pat. Publication 26845/1967, the vinylsulfone compounds described in U.S. Pat. No. 3,132,945, the N-arylvinylsulfonamides described in British Pat. No. 861,414, the maleimide compounds described in U.S. Pat. No. 3,186,846, the acrylonitriles described in U.S. Pat. No. 2,594,293, the polyalkyleneoxides described in U.S. Pat. No. 3,312,553, the epoxy compounds described in Japanese Pat. Publication 26845/1967, the acid esters described in U.S. Pat. No. 2,763,639 and the alkanesulfones described in British Pat. No. 1,033,189.

Suitable high molecular weight materials for grafting to gelatin are described in U.S. Pat. Nos. 2,763,625, 2,831,767 and 2,956,884, *Polymer Letters*, Vol. 5, 595 (1967), *Photo Sci. Eng.*, Vol. 9, 148 (1965) and *J. Polymer Sci.*, A-1, Vol. 9, 3199 (1971), and include polymers and copolymers of vinyl monomers such as acrylic acid, methacrylic acid or derivatives of these acids such as the esters, amides or nitriles, thereof or styrene, etc. However, hydrophilic vinyl polymers which are compatible with gelatin such as the polymers and copolymers of acrylic acid, acrylamide, hydroxyalkyl acrylate or hydroxyalkyl methacrylate are particularly preferred.

The silver halide photographic emulsions can be produced, in general by mixing a solution of a water soluble silver salt (for example, silver nitrate) with a solution of a water soluble halide (for example, potassium bromide) in the presence of a solution of a water soluble high molecular weight material such as gelatin. Not only silver chloride and silver bromide but also mixed silver halides such as silver bromochloride, silver iodobromide, silver iodochloride and silver iodobromochloride can be used as the silver halide. Grains of these silver halides can be produced using known conventional processes. For example, they can be effectively produced by the so-called single or double jet process or a control double jet process. Further, two silver halide photographic emulsions prepared separately may be mixed. The silver halide grains can have a homogeneous crystal structure or can have a laminar structure wherein the interior and the exterior of the crystal are composed of different materials or a conversion type structure as described in British Pat. No. 635,841 or U.S. Pat. No. 3,622,318. Further, the silver halide particles can be of the type wherein a latent image is mainly formed on a surface of the grains or the type wherein a latent image is formed in the interior of the grains. These photographic emulsions are described in C. E. K. Mees & T. H. James, *The Theory of the Photographic Process*, 3rd. Ed., MacMillan Co., New York (1966), P. Grafikides, *Chimie Photographique*, Paul Montel Co., Paris (1957) and can be produced using many known processes such as an ammonia process, a neutralization process or an acid process, etc. After formation of the silver halide grains, they are washed with water to remove the by-produced water-soluble salts (for example, potassium nitrate where silver bromide was produced using silver nitrate and potassium bromide) from the system. They are then subjected to a heat treatment in the presence of a chemical sensitizer, for example, sodium thiosulfate, N,N,N'-trimethyl thiourea, a thiocyanate complex salt or thiosulfate complex salt of monovalent gold, stannous chloride or hexamethylenetetramine to increase the sensitivity without increasing the grain size. These processes have been described in the above described reference books. Examples of other chemical sensitizers include gold compounds such as the chloroaurates or gold trichloride described in U.S. Pat. Nos. 2,399,083, 2,540,085 and 2,597,856, the salts of noble metals such as platinum, iridium, palladium, rhodium or ruthenium described in U.S. Pat. Nos. 2,448,060, 2,540,086, 2,566,245, 2,566,263 and 2,598,079, sulfur compounds which form silver sulfide by reacting with silver salts described in U.S. Pat. Nos. 1,574,944, 2,410,689, 3,189,458 and 3,501,313, and reducing materials such as stannous salts and amines described in U.S. Pat. Nos. 2,487,850, 2,518,698, 2,521,925, 2,521,926, 2,694,637, 2,983,610 and 3,201,254.

The photographic emulsions can be sensitized, if desired, by spectral sensitization or supersensitization using one or more cyanine dyes such as a cyanine, merocyanine or carbocyanine dye, etc. or a combination of a cyanine dye and a styryl dye. These color sensitization techniques are well known and described in U.S. Pat. Nos. 2,493,748, 2,519,001, 2,977,229, 3,480,434, 3,672,897, 3,703,377, 2,688,545, 2,912,329, 3,397,060, 3,615,635 and 3,628,964, British Pat. Nos. 1,195,302, 1,242,588 and 1,293,862, German Pat. Publications (OLS) 2,030,326 and 2,121,780, Japanese Pat. Publications 4936/1968, 14030/1969 and 10773/1968, U.S. Pat. Nos. 3,511,664, 3,522,052, 3,527,641, 3,615,613, 3,615,632, 3,617,295, 3,635,721 and 3,694,217, and British Pat Nos. 1,137,580 and 1,216,203. Selection of the sensitizer to be used can be decided on the basis of the end use purpose of the photosensitive material, for example, the wavelength range to be sensitized or the sensitivity of the photosensitive material, etc.

Various compounds can be added to the photographic emulsions in order to prevent a reduction of sensitivity and the generation of fog during preparation, during storage or during processing of the photosensitive material. Quite a large number of such compounds are already known, and example thereof include heterocyclic compounds such as 4-hydroxy-6-methyl-1,3,3a,7-tetrazaindene, 3-methyl-benzothiazole or 1-phenyl-5-mercaptotetrazole, etc., mercury containing compounds, mercapto compounds and metal salts, etc. Specific examples of these compounds used have been described in C. E. K. Mees & T. H. James, *The Theory of the Photographic Process*, supra, and in the following patents: U.S. Pat. Nos. 1,758,576, 2,110,178, 2,131,038, 2,173,628, 2,697,040, 2,304,962, 2,324,123, 2,394,198, 2,444,605 - 8, 2,566,245, 2,694,716, 2,697,099, 2,708,162, 2,728,633 - 5, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668 and 3,622,339, and British Pat. Nos. 893,428, 403,789, 1,173,609 and 1,200,188.

Where the silver halide photographic emulsions are used for color photographic sensitive materials, dye forming couplers are sometimes included in the silver halide photographic emulsion layers. Examples of such couplers which can be used, include 4 equivalent type diketomethylene yellow couplers and 2-equivalent type diketomethylene yellow couplers, for example, the compounds described in U.S. Pat. Nos. 3,277,157, 3,415,652, 3,447,928, 3,311,476 and 3,408,194, the compounds described in U.S. Pat. Nos. 2,875,057, 3,265,506, 3,409,439, 3,551,155, 3,551,156 and 3,582,322, and the compounds described in Japanese Pat. applications (OPI) 26133/1972 and 66836/1973; 4-equivalent type or 2-equivalent type pyrazolone magenta couplers or imidazolone magenta couplers, for example, the compounds described in U.S. Pat. Nos. 2,600,788, 2,983,608, 3,066,759, 3,062,653, 3,214,437, 3,253,924, 3,419,808, 3,476,560 and 3,582,322, Japanese Pat. Publication 20636/1970 and Japanese Pat. application (OPI) 26133/1972; and α-naphthol cyan couplers and phenol cyan couplers, for example, the compounds described in U.S. Pat. Nos. 2,474,293, 2,698,794, 3,034,892, 3,214,437, 3,253,924, 3,311,476, 3,458,315 and 3,591,383 and Japanese Pat. Publications 11304/1967 and 32461/1969. In addition, the DIR couplers as described in U.S. Pat. Nos. 3,227,554, 3,297,445, 3,253,924, 3,311,476, 3,379,529, 3,516,831, 3,617,291 and 3,705,801, and German Pat. application (OLS) 2,163,811 can be used as well. The couplers can be dispersed using the processes described in U.S. Pat. Nos. 2,304,939, 2,304,940, 2,322,027, 2,801,170, 2,801,171 and 2,749,360 to produce dispersions.

One or more surface active agents can be added to the photographic layers of the present invention. Although these agents are generally used as coating assistants, they are sometimes used for other purposes, for example, in order to improve dispersability, sensitization and photographic properites or in order to prevent electrostatic charging or adhesion, etc. These surface active agents are classified into natural surface active agents such as saponin, nonionic surface active agents such as alkylene oxide type compounds, glycerin type compounds or glycidol type compounds, cationic surface active agents such as higher alkylamines, quaternary ammonium slats, heterocyclic compounds such as pyridine compounds, phosphonium compounds and sulfonium compounds, etc., anionic surface active agents which have acid groups such as a carboxylic acid group, a sulfonic acid group, a phosphoric acid group, a sulfuric acid ester group or a phosphoric acid ester group, etc. and ampholytic surface active agents such as aminoacids, amino sulfonic acids and sulfuric acid esters or phosphoric acid esters of aminoalcohols, etc.

Some of these surface active agents have been described in U.S. Pat. Nos. 2,271,623, 2,240,472, 2,288,226, 2,739,891, 3,068,101, 3,158,484, 3,201,253, 3,210,191, 3,294,540, 3,415,649, 3,441,413, 3,442,654, 3,475,174 and 3,545,974, German Pat. application (OLS) 1,942,665, British Pat. Nos. 1,077,317 and 1,198,450, Ryohei Oda, *Kaimen-kasseizai no Gosei to sono Oyo*, 1964 edition, Maki Shoten, Tokyo (1964), A. W. Perry, *Surface Active Agents*, written by Interscience Publications Incorporated (1958), and J. P. Sisley, *Encyclopedia of Surface Active Agents*, Vol. 2, Chemical Publishing Company (1964). The fluorine containing surface active agents, e.g., as described in U.S. Pat. Nos. 3,589,906, 3,666,478, 2,559,751, 2,567,011, 2,732,398, 2,764,602, 2,806,866, 2,809,998, 2,915,376, 2,915,528, 2,934,450, 2,937,098, 2,957,031, 3,472,894 and 3,555,089, British Pat. No. 1,330,356, Japanese Pat. Publication 37304/1970, Japanese Pat. application (OPI) 9613/1972, *J. Chem. Soc.*, p. 2789 (1950) and ibid, p. 2574 and 2640 (1957), *J. Am. Chem. Soc., Vol.* 79, p. 2549 (1957) and *J. Japan Oil Chemists Soc.*, Vol. 12, p. 653, can be used.

In the present invention, a lubricant composition for reducing the surface coefficient of friction of the photographic element, for example, the silicones described in U.S. Pat. Nos. 3,079,837, 3,080,317, 3,545,970 and 3,294,537 or modified silicones represented by the following formula, can be present on a surface of the support or can be included in a photographic layer:

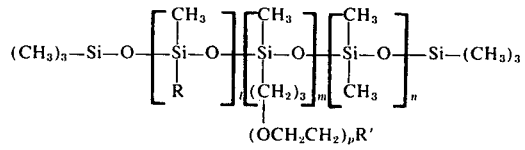

wherein $l$ is 0 to 100; $m$ is 0 to 100; $l+m+n$ is 15 to 1000; $p$ is 1 to 100; R represents a $C_1$ to $C_{18}$ alkyl group, and $R_1$ represents H or a $C_1$ to $C_{18}$ alkyl group.

The photographic materials of the present invention can include known antistatic agents such as the hydrophilic polymers described, for example, in U.S. Pat. Nos. 2,725,927, 2,972,535, 2,972,536, 2,972,537, 2,972,538, 3,033,679, 3,072,484, 3,262,807, 3,525,621, 3,615,531, 3,630,743, 3,653,906, 3,655,384 and 3,655,386 and British Pat. Nos. 1,222,154 and 1,235,075, the hydrophobic polymers described in, for example, U.S. Pat. Nos. 2,973,263 and 2,976,148, the biguanide compounds described in, for example, U.S. Pat. Nos. 2,584,362 and 2,591,590, the sulfonic acid type anionic compounds described in, for example, U.S. Pat. Nos. 2,639,234, 2,649,372, 3,201,251 and 3,457,076, the phosphoric acid esters and quaternary ammonium salts described in, for example, U.S. Pat. Nos. 3,317,344 and 3,514,291, the cationic compounds described in, for example, U.S. Pat. Nos. 2,882,157, 2,982,651, 3,399,995, 3,549,369 and 3,564,043, the nonionic compounds described in, for example, U.S. Pat. Nos. 3,625,695, the amphoteric compounds described in, for example, U.S. Pat. No. 3,736,268, the complex compounds described in, for example, U.S. Pat. No. 2,647,836 and the organic salts described in, for example, U.S. Pat. Nos. 2,717,834 and 3,655,387.

The photographic layer of the present invention can include aldehyde compounds such as formaldehyde or glutaraldehyde, ketone compounds such as diacetyl or cyclopentanedione, the reactive halogen containing compounds described in U.S. Pat. Nos. 3,288,775 and 2,732,303 and British Pat. Nos. 974,723 and 1,167,207 as well as bis-(2-chloroethylurea) and 2-hydroxy-4,6-dichloro-1,3,5-triazine, the reactive olefin containing compounds described in U.S. Pat. Nos. 3,635,718 and 3,232,763 and British Pat. No. 994,869 as well as divinylsulfone, and 5-acetyl-1,3-diacryloyhexahydro-1,3,5-triazine, the N-methylol compounds described in U.S. Pat. Nos. 2,732,316 and 2,586,168 as well as N-hydroxymethylphthalimide, the isocyanates described in U.S. Pat. No. 3,103,437, the aziridine compounds described in U.S. Pat. Nos. 3,017,280 and 2,983,611, the acid derivatives described in U.S. Pat. Nos. 2,725,294 and 2,725,295, the carbodimide compounds described in U.S. Pat. No. 3,100,704, the epoxy compounds described in U.S. Pat. No. 3,091,537, the isoxazole compounds described in U.S. Pat. Nos. 3,321,313, and 3,543,292, the halocarboxyaldehydes such as mucochloric acid, dioxane derivatives such as dihydroxydioxane or dichlorodioxane and inorganic hardening agents such as chromium alum or zirconium sulfate, etc. as hardening agents. Furthr, precursor type compounds such as alkali metal bisulfite-aldehyde adducts, methylol derivatives of hydantoin and primary aliphatic nitroalcohols can be used instead of the above described compounds. The auxiliary layers and particularly the adjacent layers can contain the above described stabilizers and antifogging agents in the photographic sensitive materials of the present invention.

The photographic sensitive materials of the present invention can contain the polyols described in U.S. Pat. Nos. 2,960,404, 3,520,694, 3,656,965 and 3,640,721 as plasticizers in the photographic layers thereof.

The photographic sensitive materials of the present invention can contain in the auxiliary layers thereof stilbene compounds, triazine compounds, oxazole compounds or coumarin compounds as whitening agents; benzotriazole compounds, thiazolidine compounds or cinnamic acid ester compounds as ultraviolet light absorbing agents; known filter dyes for photography as light absorbing agents; water-insoluble materials as described in British Pat. Nos. 955,061, 1,320,564, 1,320,565 and 1,143,118 and U.S. Pat. Nos. 3,121,060 and 3,489,567 and surface active materials as described in U.S. Pat. No. 3,617,286 as adhesion preventing agents, Further, they can contain inorganic compounds having a suitable particle size such as silver halide, silica or strontium barium sulfate or a latex such as a polymethyl methacrylate latex as a matting agent.

The photographic sensitive materials of the present invention can have an antihalation layer as described above. In such case, carbon black or known antihalation dyes such as triphenylmethane dyes, oxonol dyes, styryl dyes such as benzylidene or cinnamylidene derivatives, cyanine dyes or metal containing (chelate) dyes can be added to the antihalation layer as halation preventing agents. Some of these materials has been described in, for example, U.S. Pat. Nos. 2,150,695, 2,527,583, 3,282,699, 2,274,782, 2,621,125, 3,647,460, 3,653,905, 2,036,546, 3,615,546, 3,260,601, 3,745,009, 3,364,029, and 3,406,069 and British Pat. No. 584,609.

The silver halide emulsions include ortho emulsions, panchromatic emulsions, emulsions for infrared rays, emulsions for X rays or other invisible rays, litho emulsions, and color photographic emulsions such as an emulsion containing a color forming coupler, an emulsion containing a dye developing agent or an emulsion containing a bleachable dye, etc.

According to the present invention, difficulties occurring during production or use of the photographic sensitive material have been improved. For example, the generation of static marks caused by containing the emulsion layer surface of the photographic sensitive material with the back surface thereof or contacting the photosensitive material with other materials such as rubber, metals, plastics or fluorescence sensitizing paper (used for X-ray films) is remarkably decreased. Particularly, as described in the following examples, the surface resistivity is remarkably decreased when the compound used in the present invention is applied to a surface layer of the emulsion side of the photographic film. On the contrary, the surface resistivity hardly decreases when many known surface active agents and known antistatic agents for photography such as saponin, aliphatic acid esters of sucrose or the compounds described in U.S. Pat. Nos. 2,982,651, 3,253,922 and 3,220,847 are applied to the surface layer of the emulsion side.

Further, the generation of electrostatic charges caused by setting the film in a cartridge, loading the film in a camera or continuously photographing at a high speed using an automatic camera such as in X-ray films can be effectively prevented even at a low humidity. Furthermore, the antistatic effect does not deteriorate with the lapse of time. Moreover, difficulties such as a slipping of superposed films at cutting or a sliding of a rolled film in a camera do not occur at all.

The present invention will be illustrated in greater detail with reference to the following examples which are not intended to be construed as limiting the present invention. Unless otherwise indicated herein, all parts, percents, ratios and the like are by weight.

In the examples, the evaluation of antistatic properties was carried out by determinations of the magnitude of the electrostatic charge, the surface resistivity and the generation of static marks.

EXAMPLE 1

A photographic emulsion coating solution which was prepared by adding additives such as a stabilizer and a hardening agent as described below to a high speed emulsion for X-rays containing 6 percent of gelatin and 6 percent of silver iodobromide (silver iodide: 1.5 mol%) was applied to a polyethylene terephthalate film having a subbing layer thereon, and then an aqueous solution containing gelatin as a major component which did not contain an antistatic agent was applied on the silver halide emulsion layer to form a surface protective layer. The composition of each layer are shown in Table 1 below.

Table 1

| Component | Coating Solution Composition (per Kg) Coating Solution for Emulsion Layer | Coating Solution for Protective Layer |
|---|---|---|
| Binder | Gelatin | Gelatin 50 g |
| Silver | Silver iodobromide | — |
| Hardening Agent | 2% Aqueous solution of sodium salt of 2-hydroxy-4,6-dichloro-s-triazine (5 ml) | 2% Aqueous solution of sodium salt of 2-hydroxy-4,6-dichloro-s-triazine (10 ml) |
| Stabilizer | 2% Aqueous solution of 1-phenyl-5-mercapto-tetrazole (10 ml) | — |
| Water | 880 ml | 500 ml |
| (Film thickness: Emulsion layer: 5 $\mu$, Protective layer: 1 $\mu$) | | |

The resulting sample was divided into test samples and each sample was dipped in a 3 percent aqueous solution of the compound of the present invention (Compound 1 or 3) for 30 seconds respectively and then dried. For comparison, samples were processed in the same manner with a 3 percent aqueous solution of saponin, sucrose monolaurate or polyoxyethylene nonylphenyl ether respectively. After conditioned at 25°C and 30 percent RH for 10 hours, the surface resistivity of these samples of the photographic film was determined in the following manner.

The determination of the surface resistivity was carried out by putting a test film between brass electrodes (stainless steel was used in the part contacting the test film) having a length of 10 cm at a separation of 0.14 cm and determining one minute value using an insulation tester (Type MM-V-M) produced by Takeda Riken Co.

Further, generation of the static marks was evaluated by superposing a white rubber plate on a surface of the sample, pressing the white rubber plate with a rubber roll at 25°C and 40 percent RH to produce friction, removing the white rubber plate, developing the sample in a developer having the following composition and fixing the sample.

| Composition of the Developer: | |
|---|---|
| Warm Water (50°C) | 700 ml |
| Sodium N-methyl-p-aminophenol Sulfate | 4 g |
| Sodium Sulfite (anhydrous) | 60 g |
| Hydroquinone | 10 g |
| Sodium Carbonate (monohydrate) | 53 g |
| Potassium Bromide | 25 g |
| Water to make | 1 liter |

The results obtained are shown in Table 2.

Table 2

| Sample No. | Antistatic Agent | Antistatic Evaluation Surface Resistivity | Amount of Static Marks |
|---|---|---|---|
| 1 | Compound 1 | $3 \times 10^{10}(\Omega)$ | A |
| 2 | Compound 5 | $2 \times 10^{11}$ | A |
| 3 | Compound 16 | $8 \times 10^{10}$ | A |
| 4 | Compound 10 | $4 \times 10^{10}$ | A |
| 5 | Saponin | $10^{14}$ | D |
| 6 | Sucrose Monolaurate | $5 \times 10^{13}$ | C |
| 7 | Polyoxyethylene Nonylphenyl Ether (10 oxyethylene units) | $3 \times 10^{13}$ | C |
| 8 | None (Control) | $10^{14}$ | E |

The amount of static marks was evaluated by the following 5 stages.

| Grade | Static Mark Generation |
|---|---|
| A | None |
| B | Slight |
| C | Considerable |
| D | Remarkable |
| E | Over entire surface |

As is clear from the results in Table 2, in the photographic films processed with the aqueous solution of the compound of the present invention (Sample Nos. 1, 2, 3 and 4), the generation of static marks was not observed or only slightly observed and the surface resistivity decreased remarkably. On the other hand, in the samples processed with saponin, sucrose monolaurate and polyoxyethylene nonylphenyl ether (Sample Nos. 5, 6 and 7), static marks markedly occured and the surface resistivity hardly decreased. In the control sample (Sample No. 8), the entire surface was covered with static marks.

EXAMPLE 2

To a high-speed emulsion for high-speed X-ray photography containing 7 percent of gelatin and 8 percent of silver iodobromide (silver iodide: 1.5 mol%), the same additives such the same stabilizer, hardening agent and sensitizer as in Example 1 and a 4 percent aqueous solution of saponin in the amount of 5 ml per 1 Kg of the emulsion were added. This photographic emulsion was applied to both surfaces of a polyethylene terephthalate support having subbing layers thereon. After cooling the subbed support, a coating solution prepared by adding 20 ml of a 10 percent aqueous solution of the compound of the present invention (Compound 1) as an antistatic agent to 1 Kg of a 2 percent aqueous gelatin solution containing the sodium salt of 2-hydroxy-4,6-dichloro-s-triazine as a hardening agent was applied to both emulsion layers. After cooling the sample was dired. The resulting emulsion layers and the protective layers each had a thickness of 5 $\mu$ and 1 $\mu$ respectively. The coated surfaces were uniform and even and had good quality. On the other hand, a photographic film wherein the same amount of a known agent, sodium dioctylsulfosuccinate, as a comparison compound was added to the protective layer and a photographic film which did not contain any antistatic agent (control) were produced using the same procedures. After conditioning these films at 25°C and 30 percent RH for 10 hours, the surface resistivity and generation of static marks were examined in the same manner as in Example 1. The results obtained are shown in Table 3.

Table 3

| Antistatic Agent | Surface Resistivity (Ω) | Generation of Static Marks |
|---|---|---|
| Compound 1 | $2 \times 10^{11}$ | A |
| Sodium Dioctylsulfosuccinate (comparison compound) | $3 \times 10^{13}$ | D |
| None (Control) | $10^{14}$ | E |

As can be seen from the results in Table 3, in the photographic film wherein the antistatic agent of the present invention was added to the protective layer, the surface resistivity decreased markedly. On the contrary, in the photographic film wherein sodium dioctylsulfosuccinate was added to the protective layer, the surface resistivity hardly decreased.

EXAMPLE 3

20 ml of a 10 percent aqueous solution of Compound 2 of the present invention was added to a high-speed emulsion containing 6 percent of gelatin and 12 percent of silver iodobromide (silver iodide: 6.0 mol%). A coating solution for forming a surface protective layer was prepared by adding 50 ml of a 5 percent aqueous solution of polyoxyethylenesorbitan monolaurate (15 oxyethylene units) as a coating assistant to 1 Kg of a 7 percent aqueous solution of gelatin containing a hardening agent. Then, the above described photographic emulsion and the coating solution for forming the surface protective layer were applied in turn to a cellulose triacetate support having a subbing layer thereon. After cooling the sample was dried. The surface resistivity and the generation of static marks were examined in the same manner as in Example 1. The surface resistivity at 20°C and 40% RH was $7.5 \times 10^{11}\Omega$ in the photographic film in which the compound of the present invention was added to the emulsion layer. On the contrary, it was $8.5 \times 10^{13}\Omega$ in the photographic film in which the compound of the present invention was not added.

EXAMPLE 4

5 ml of a 4 percent aqueous solution of saponin as a coating assistant was added to 1 Kg of a high-speed emulsion containing 6 percent of gelatin and 12 percent of silver iodobromide (silver iodide: 8.6 mol%). The emulsion was applied to a cellulose triacetate support having a subbing layer. Then, a coating solution for forming a surface protective layer which was prepared by adding 60 ml of a 10 percent aqueous solution of Compound 5 of the present invention to 1 Kg of a 5 percent aqueous solution of gelatin containing the sodium salt of 2-hydroxy-4,6-dichloro-S-triazine (15 ml of a 2 percent aqueous solution per Kg of the emulsion) as a hardening agent was applied to the resulting emulsion layer. After cooling the sample was dried to produce a photographic film sample. Similarly, a coating solution which was prepared by adding 60 ml of a 10 percent aqueous solution of Compound 5 of the present invention and 30 ml of a 1 percent aqueous solution of a fluorine containing surface active agent as an antistatic agent having the formula

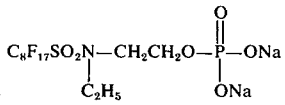

to the above described aqueous solution of gelatin was applied in the same manner as described above to produce a photographic film sample.

For comparison, a photographic film sample having a surface protective layer wherein 50 ml of a 10 percent aqueous solution of saponin was added was produced in the same manner. The surface resistivity of these film samples was determined in the same manner as in Example 1 and the surface adhesion property was determined by the following method. Two square test pieces (4 cm side length) were cut off from each of the resulting photographic film samples, and were conditioned at 35°C and 90 percent RH for 2 days while not contacting with each other. The protective layers of the pair test pieces which cut off from the same film sample were then contacted and stored for 1 day under a load of 800 g at 35°C and 90 percent RH. Each of the pair test pieces was then peeled and adhered areas in each test pieces were determined. The anti-adhesive property was evaluated by the following 4 stages.

| Grade | Adhered Area (%) |
|---|---|
| A | Less than 40 |
| B | 41 to 60 |
| C | 61 to 80 |
| D | More than 81 |

The results obtained are shown in Table 4.

Table 4

| Antistatic Agent | Surface Resistivity (Ω) | Adhesive Property |
|---|---|---|
| Compound 10 | $8 \times 10^{11}$ | A |
| Compound 5 | $2 \times 10^{11}$ | B |
| Compound 5 and Fluorine Containing Surface Active Agent | $7 \times 10^{11}$ | A |
| Saponin | $1 \times 10^{14}$ | D |

As is clear from the results in Table 4, the surface resistivity decreased in the photographic film samples in which the compound of the present invention was added to the surface protective layer.

EXAMPLE 5

To one face of a cellulose triacetate support, an antistatic solution (A) having the following composition containing the compound of the present invention was applied. For to comparison, a comparison solution (B) having the same composition but not containing the compound of the present invention was applied in the same manner. These film supports were dried at 80°C for 10 minutes (coating film thickness: 0.3 $\mu$).

| | Antistatic Solution (A) | | Comparison Antistatic Solution (B) | |
|---|---|---|---|---|
| Cellulose Diacetate | 0.2 | g | 0.2 | g |
| Water | 10 | g | 10 | g |
| Methanol | 50 | g | 50 | g |
| Acetone | 40 | g | 40 | g |
| Comound of the Present Invention | 0.1 | g | — | |

After conditioned these photographic film supports at 23°C and 60 percent RH for 5 hours, the surface resistivity was determined. The surface resistivity was $2 \times 10^{16}\Omega$ in the film support to which the comparison solution (B) was applied, while it was $4.5 \times 10^{9}\Omega$ in the film support to which the antistatic solution (A) was applied.

EXAMPLE 6

On a cellulose triacetate film support, an antihalation layer, a red-sensitive silver halide emulsion layer, an intermediate layer, a green-sensitive silver halide emulsion layer, a yellow filter layer, a blue-sensitive silver halide emulsion layer and a protective layer were coated in turn to produce a color photographic film.

The antihalation layer was a gelatin layer containing a black colloidal silver dispersion (0.36 g/m$^2$), which contained Hardening Agent 1 and Coating Assistant 1 described below.

The red-sensitive silver halide emulsion layer contained Sensitizing Dye 2, Stabilizer 1, Hardening Agent 2, Coating Assistant 1, Color Couplers 4 and 5, and Coupler Solvents 1 and 2 in a gelatin-silver iodobromide emulsion (iodide content: 2.0 mol %).

The intermediate layer was a gelatin layer containing Hardening Agent 1, Coating Assistant 1 and Coupler Solvent 3.

The green-sensitive silver halide emulsion layer contained Sensitizing Dye 1, Stabilizer 1, Hardening Agent 2, Coating Assistant 1, Color Couplers 2 and 3 and Coupler Solvents 1 and 2 in a gelatin-silver iodobromide emulsion (iodide content: 3.3 mol %).

The yellow filter layer was a gelatin layer containing a yellow colloidal silver dispersion, which contained Hardening Agent 1 and Coating Assistant 2.

The blue-sensitive silver halide emulsion layer contained Stabilizer 1, Hardening Agent 2, Color Coupler 1 and Coupler Solvents 1 and 2 in a gelatin-silver iodobromide silver emulsion (iodide content: 3.3 mol %).

As the surface protective layer, two samples were used, that is, one sample was composed of 1.0 g of gelatin and 0.5 g of a styrene-maleic acid copolymer (limiting viscosity determined in a 1 percent aqueous solution of sodium chloride: 0.40) as binders per m$^2$ of the surface protective layer, 0.5 g/100 g binder of Hardening Agent 1, 5.0 g/100 g binder of the compound of the present invention (Compound 1) as the antistatic agent, and 0.8 g/100 g of polymethyl methacrylate particles (average particle size: 2 microns) as a matting agent, and one sample which was a comparison sample had the same composition as described above but contained 3.0 g/100 g binder of sodium dodecylbenzene sulfonate instead of the compound of the present invention (compound 1).

The additives used in each layer were as follows:

Sensitizing Dye 1: Anhydro-5,5′-diphenyl-9-ethyl-3,3′-di-(2-sulfoethyl)oxacarbocyanine hydroxide pyridinium salt Sensitizing Dye 2: Anhydro-5,5′-dichloro-9-ethyl-3,3′-di-(3-sulfopropyl)thiacarbocyanine hydroxide pyridinium salt Stabilizer 1: 4-Hydroxy-6-methyl-1,3,3a,7-tetrazaindene Hardening Agent 1: 2-Hydroxy-4,6-dichloro-a-triazine sodium salt Hardening Agent 2: Hexahydro-1,3,5-triacryloyl-s-triazine Surface Active Agent 1: Sodium dodecylbenzene sulfonate Surface Active Agent 2: 2-Sulfonate succinic acid bis-(2-ethylhexyl) ester sodium salt Coupler Solvent 1: Di-n-butylphthalate Coupler Solvent 2: Tri-[N-(2-hydroxyethyl)]cyanuric acid Coupler Solvent 3: Tricresyl phosphate Color Coupler 1: 2′-Chloro-5′-[2-(2,4-di-tert-amylphenoxy)-butyramido]-$\alpha$-(5,5-dimethyl-2,4-dioxo-3-imidazolidinyl)-$\alpha$-(4-methoxybenzoyl)acetoanilide Color Coupler 2: 1-(2,4,6-Trichlorophenyl)-3-{3-[(2,4-di-tertamylphenoxy)acetamido]benzamido}-4-(4-methoxyphenyl)azo-5-pyrazolone Color Coupler 3: 1-(2,4,6-Trichlorophenyl)-3-{3-[(2,4-di-tertamylphenoxy)acetamido]benzamido}-5-pyrazolone Color Coupler 4: 1-Hydroxy-4-(2-acetylphenyl)-azo-N-[4-(2,4-di-tert-amylphenoxy)butyl]-2-naphthamide Color Coupler 5: 1-Hydroxy-N-dodecyl-2-naphthamide After the resulting samples were conditioned at 25°C and 30 percent RH for 20 hours, the surface resistivity and generation of static marks were examined in the same manner as in Example 1.

In the photographic film in which the compound of the present invention was added to the surface protective layer, the surface resistivity was $5 \times 10^{11}\Omega$ and no generation of static marks was observed. On the contrary, in the comparison film, wherein the compound of the present invention was not added, the surface resistivity was $6 \times 10^{13}\Omega$ and static marks were generated markedly.

While the invention has been described in detail and with reference to specific embodiments thereof, it will be apparent to one skilled in the art that various changes and modifications can be made therein without departing from the spirit and scope thereof.

What is claimed is:

1. An antistatic photographic sensitive material comprising a support having thereon at least one silver halide emulsion layer, wherein a surface active copolymer containing in the main chain an alkyl repeating unit represented by the formula (I)

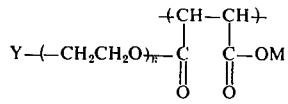

(I)

wherein Y represents an organic residue having 4 to 22 carbon atoms; n represents the average number of ethyleneoxy units and is 1 to 100; and M represents a hydrogen atom, an alkali metal atom, an alkaline earth metal atom, an ammonium group or an alkylammonium group is present in at least one of a surface of the support and a photographic layer.

2. The antistatic photographic sensitive material of claim 1, wherein Y is a linear, branched-chain or cyclic, saturated or unsaturated, unsubstituted or substituted hydrocarbon group.

3. The antistatic photographic sensitive material of claim 1, wherein Y is a group R—O—, a

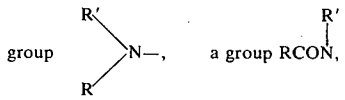

a group RCOO—, a group R—S— or a

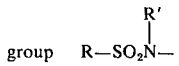

wherein R and R′, which may be the same or different, each represents an alkyl group which may be completely or partially substituted with fluorine atoms; an alkenyl group; an aralkyl group; or an aryl group; and R′ further represents a hydrogen atom, M is a hydrogen atom, a sodium atom, a potassium atom, a lithium atom, a calcium atom, a barium atom, an ammonium group, or an alkyl ammonium group having 1 to 4 carbon atoms in the alkyl moieties.

4. The antistatic photographic sensitive material of claim 1, wherein said copolymer containing therein said repeating unit of the formula (I) is a copolymer of a comonomer selected from the group consisting of an alkyl acrylate, a methacrylate, a vinyl ester, a vinyl ether, a vinyl ketone, a styrene, a vinyl heterocyclic compound, an acrylonitrile, a vinyl or vinylidene halide, or an olefin.

5. The antistatic photographic sensitive material of claim 1, wherein said surface active copolymer containing therein a repeating unit represented by the formula (I) is a compound represented by the formula

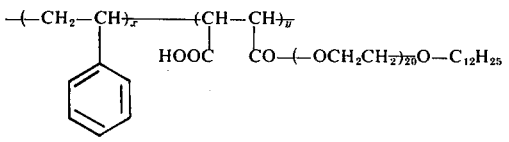

wherein a molar ratio of $x$ to $y$ is 1 to 1.

6. The antistatic photographic sensitive material of claim 1, wherein said surface active copolymer containing therein a repeating unit represented by the formula (I) is a compound represented by the formula

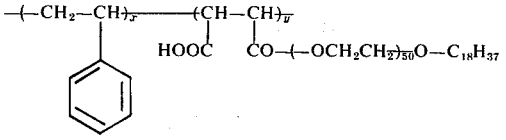

wherein a molar ratio of $x$ to $y$ is 1 to 1.

7. The antistatic photographic sensitive material of claim 1, wherein said surface active copolymer containing therein a repeating unit represented by the formula (I) is a compound represented by the formula

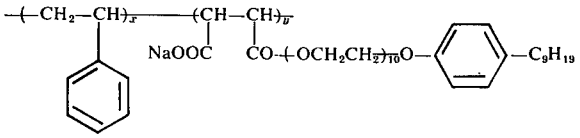

wherein a molar ratio of $x$ to $y$ is 1 to 1.

8. The antistatic photographic sensitive material of claim 1, wherein said surface active copolymer containing therein a repeating unit represented by the formula (I) has a molecular weight of about 500 to 50,000.

9. The anti-static photographic sensitive material of claim 1, wherein said surface active copolymer containing therein a repeating unit represented by the formula (I) has a molecular weight of 1,000 to 20,000 and $n$ is 2 to 50.

10. The antistatic photographic sensitive material of claim 1, wherein said surface active copolymer containing therein a repeating unit represented by the formula (I) is present in said photographic sensitive material and in an amount of about 0.05 to 20 g per square meter of said photographic sensitive material.

11. The antistatic photographic sensitive material of claim 1, wherein said photographic layer is a silver halide emulsion layer, an intermediate layer, a protective layer, a filter layer, a backing layer, an anti-halation layer, an antistatic layer, an anti-curling layer or a subbing layer.

12. A method of enhancing the antistatic properties of a photographic sensitive material comprising a support having thereon at least one silver halide emulsion layer which comprises applying to at least one surface of said support or applying to or incorporating in a photographic layer on said support a surface active copolymer containing in the main chain a repeating unit represented by the following formula (I)

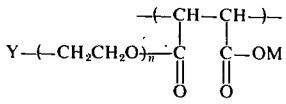

(I)

wherein Y represents an organic residue having 4 to 22 carbon atoms; n represents the average number of ethyleneoxy units and is 1 to 100; and M represents a hydrogen atom, an alkali metal atom, an alkaline earth metal atom, an ammonium group or an alkylammonium group.

* * * * *